US006959469B2

(12) United States Patent
Blauer et al.

(10) Patent No.: US 6,959,469 B2
(45) Date of Patent: Nov. 1, 2005

(54) PLIABLE HEADER

(75) Inventors: Jeff Blauer, Portland, OR (US); Stan Blauer, Portland, OR (US)

(73) Assignee: She drain Corporation, Portland, OR (US)

( * ) Notice: Subject to any disclaimer, the term of this patent is extended or adjusted under 35 U.S.C. 154(b) by 0 days.

(21) Appl. No.: 10/693,152

(22) Filed: Oct. 23, 2003

(65) Prior Publication Data

US 2004/0205938 A1 Oct. 21, 2004

Related U.S. Application Data

(63) Continuation-in-part of application No. 10/418,811, filed on Apr. 17, 2003.

(51) Int. Cl.[7] ..... A45C 7/00; E05B 1/00

(52) U.S. Cl. ..... 16/431; 16/436; 16/421; 16/DIG. 12; 16/DIG. 19; 81/489; 81/177.1; 135/25.4

(58) Field of Search ..... 16/430, 431, 435, 16/436, 421, DIG. 12, DIG. 18, DIG. 19; 15/143.1, 144.1, 145, 443; 81/177.1, 177.6, 81/489; 74/551.1, 557, 558, 551.9; 401/6–8, 401/88; 156/218, 212; 473/300–303; 30/322, 30/323, 340; 135/24, 25, 25.41, 25.4; D3/5–6, D3/10, 12

(56) References Cited

U.S. PATENT DOCUMENTS 4,035,089 A * 7/1977 Schwartz et al. ..... 401/6
4,044,625 A * 8/1977 D'Haem et al. ..... 74/558.5
4,338,270 A * 7/1982 Uffindell ..... 264/46.4
D290,905 S * 7/1987 Selig ..... D3/16
4,719,063 A * 1/1988 White ..... 264/45.2
4,934,024 A * 6/1990 Sexton, I ..... 16/421
4,934,066 A * 6/1990 Rose ..... 34/333
5,000,599 A * 3/1991 McCall et al. ..... 401/6
5,155,878 A * 10/1992 Dellis ..... 16/421
5,355,552 A * 10/1994 Huang ..... 16/421
5,458,144 A * 10/1995 Lavine ..... 135/24
5,713,104 A * 2/1998 Giampaolo, Jr. ..... 16/422
6,094,781 A * 8/2000 Jansson et al. ..... 16/431
6,148,483 A * 11/2000 DeGraff ..... 16/430
6,647,582 B1 * 11/2003 Rechelbacher ..... 15/143.1

FOREIGN PATENT DOCUMENTS

DE 4030133 A1 * 4/1991 ..... A63B 49/08
EP 519312 A1 * 12/1992 ..... A63B 49/08
JP 07205055 A * 8/1995 ..... B25G 1/01

* cited by examiner

*Primary Examiner*—Chuck Y. Mah
(74) *Attorney, Agent, or Firm*—Darby & Darby

(57) ABSTRACT

A pliable handle for a hand-held device is provided. The handle includes a core member, an outer sheath disposed about the core member, and gel disposed between the core member and the outer sheath. The outer sheath is deformable, such that when a hand grips the pliable handle, the force applied causes the pliable handle to deform and conform to the shape of the hand, and the applied force causes load movement of the gel. The pliable handle has a so-called memory effect, meaning that after the grip on the handle is released, the deformation in the handle will remain for a period of time before the handle returns to its original shape.

25 Claims, 14 Drawing Sheets

Fig. 6
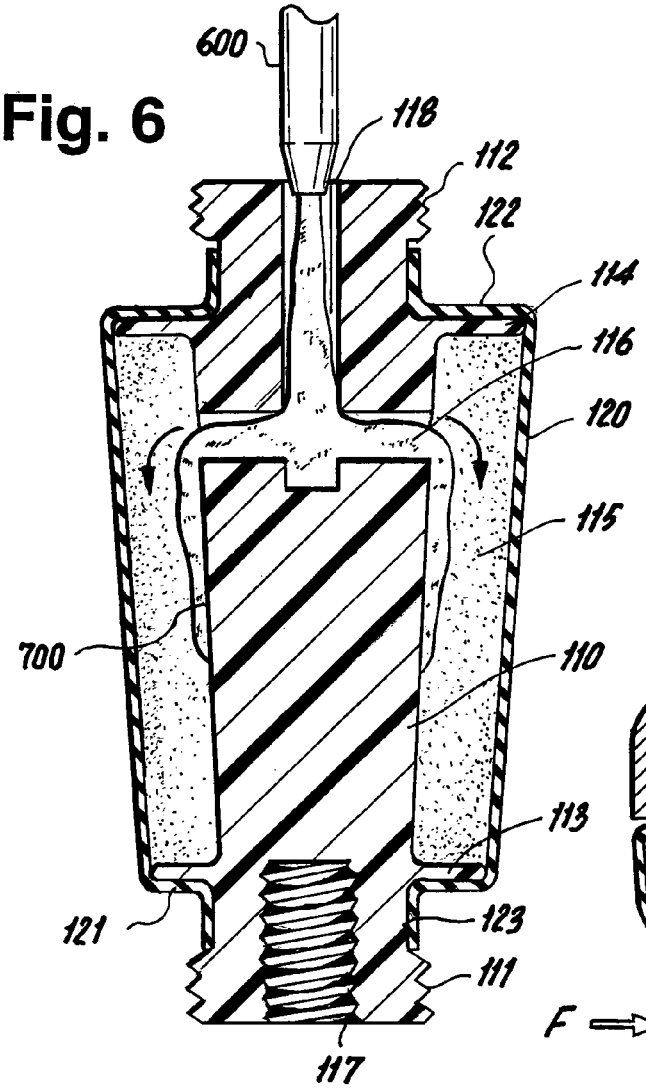
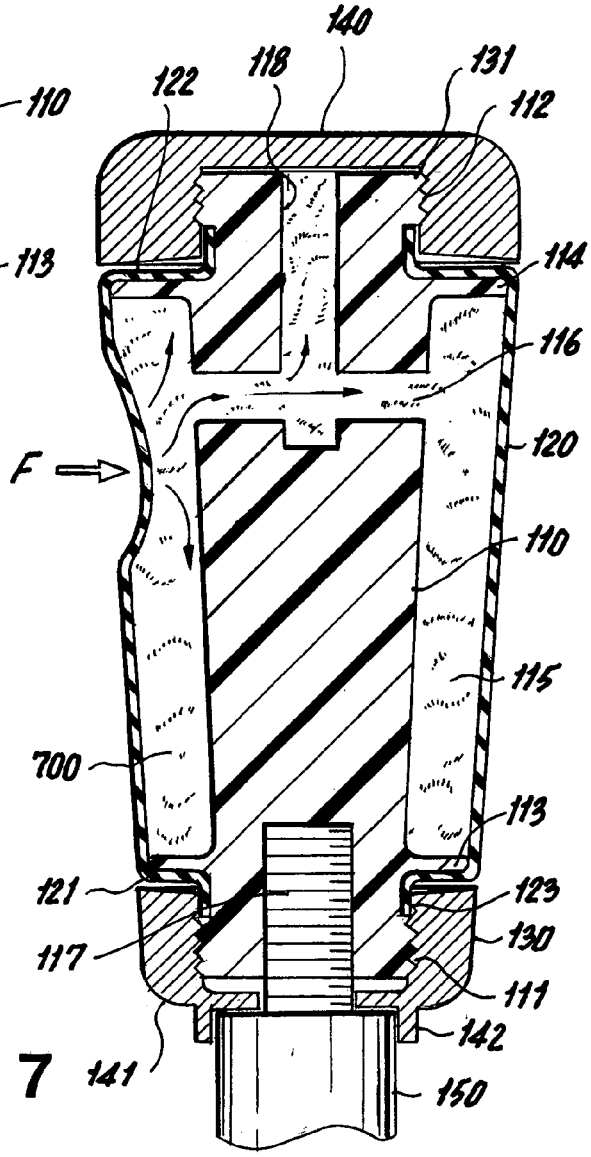
Fig. 7

PLIABLE HEADER

RELATED APPLICATIONS

This application in a continuation-in-part of U.S. patent application Ser. No. 10/418,811, entitled "PLIABLE HANDLE" and filed on Apr. 17, 2003.

TECHNICAL FIELD

The present invention relates generally to handles, and more particularly to handles that are pliable.

BACKGROUND

Handles of devices, such as umbrellas, canes, walking sticks, sports equipment, garden equipment, tools, kitchen tools, cleaning equipment, writing instruments, beauty equipment, etc., have been known for many years. Users are often required to grip such handles for an extended period of time leading to discomfort.

Umbrellas, for example, which are used for protection from elements such as rain and sun, generally consist of a collapsible canopy mounted on one end of a central rod and a handle mounted on the other end. During inclement weather especially, users tend to grip the handle tightly. The stiff, rigid handle promotes finger fatigue. Also, plastic handles tend to become slippery when wet, and the user might lose grasp of the handle. And in high winds, this could lead to loss of the umbrella.

Other types of handles also suffer from similar problems of causing finger fatigue and becoming slippery when wet. It is therefore desirable to overcome the above disadvantages by providing a handle that will reduce hand fatigue and provide a more comfortable, secure grip.

SUMMARY

A pliable handle for a hand-held device is provided. The handle includes a core member, an outer sheath disposed about the core member, and gel disposed between the core member and the outer sheath. The outer sheath is deformable, such that when a hand grips the pliable handle, the force applied causes the pliable handle to deform and conform to the shape of the hand, and the applied force causes load movement of the gel.

Further aspects and features of the exemplary apparatus disclosed herein can be appreciated from the appended Figures and accompanying written description.

BRIEF DESCRIPTION OF THE DRAWINGS

The invention will be more fully understood by reference to the following drawings which are for illustrative purposes only:

FIG. 6 is a cross-sectional view of the assembled pliable handle of FIG. 1 illustrating movement of gel during injection;

FIG. 7 is a cross-sectional view of the assembled pliable handle of FIG. 1 illustrating movement of gel while a force exerting pressure is applied to the handle;

DETAILED DESCRIPTION OF THE PREFERRED EMBODIMENTS

Figure 1:
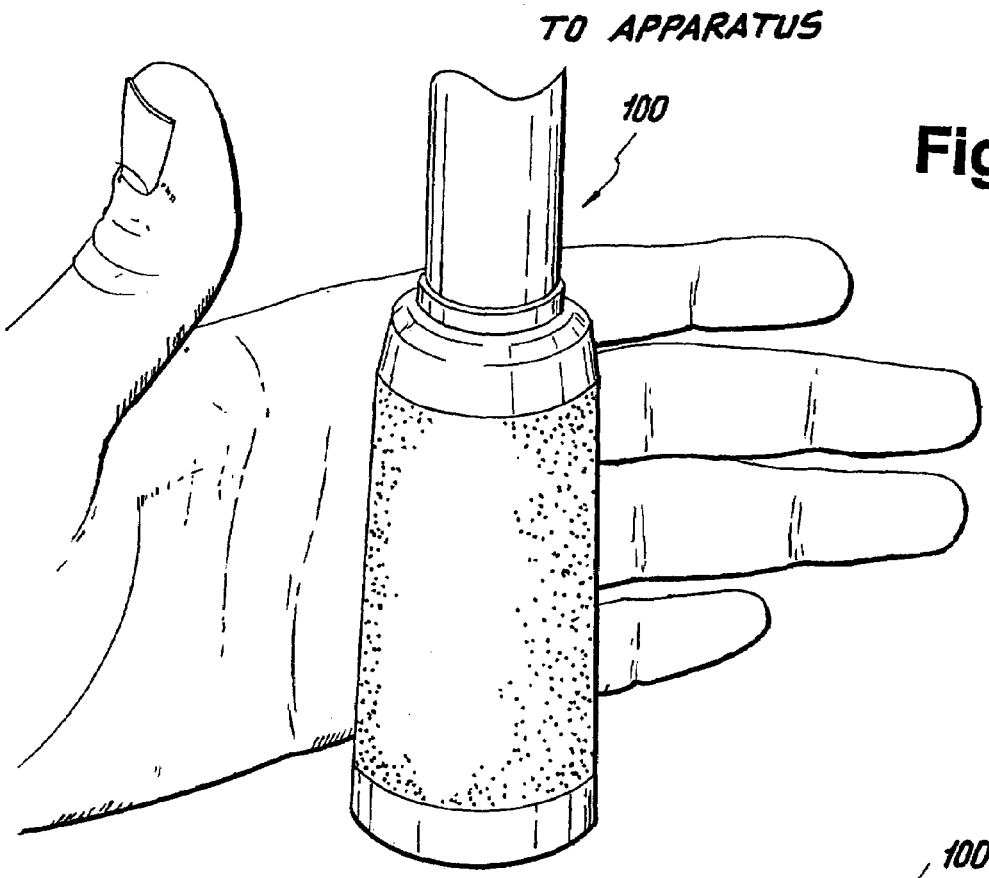
FIG. 1 is a perspective view of a pliable handle according to one exemplary embodiment.
Figure 2:
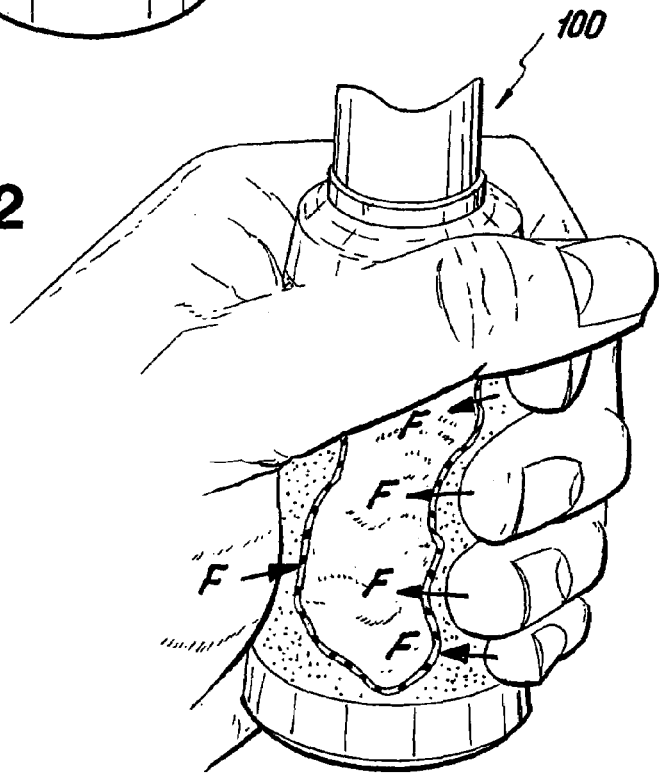
FIG. 2 is a perspective view showing the pliable handle of FIG. 1 in partial cutaway and being gripped by a hand.

FIG. 1 is a perspective view of a pliable handle 100 according to one exemplary embodiment. FIG. 2 is a perspective view showing the pliable handle 100 in partial cutaway and being gripped by a hand. As the hand grips the pliable handle 100, forces applied in directions indicated by the arrows cause the pliable handle to deform and conform to the shape of the hand. The pliable handle 100 has a so-called memory effect, meaning that after the grip on the handle is released and the forces are removed, the deformation in the handle will remain for a period of time before the handle returns to its original shape.

Figure 3:
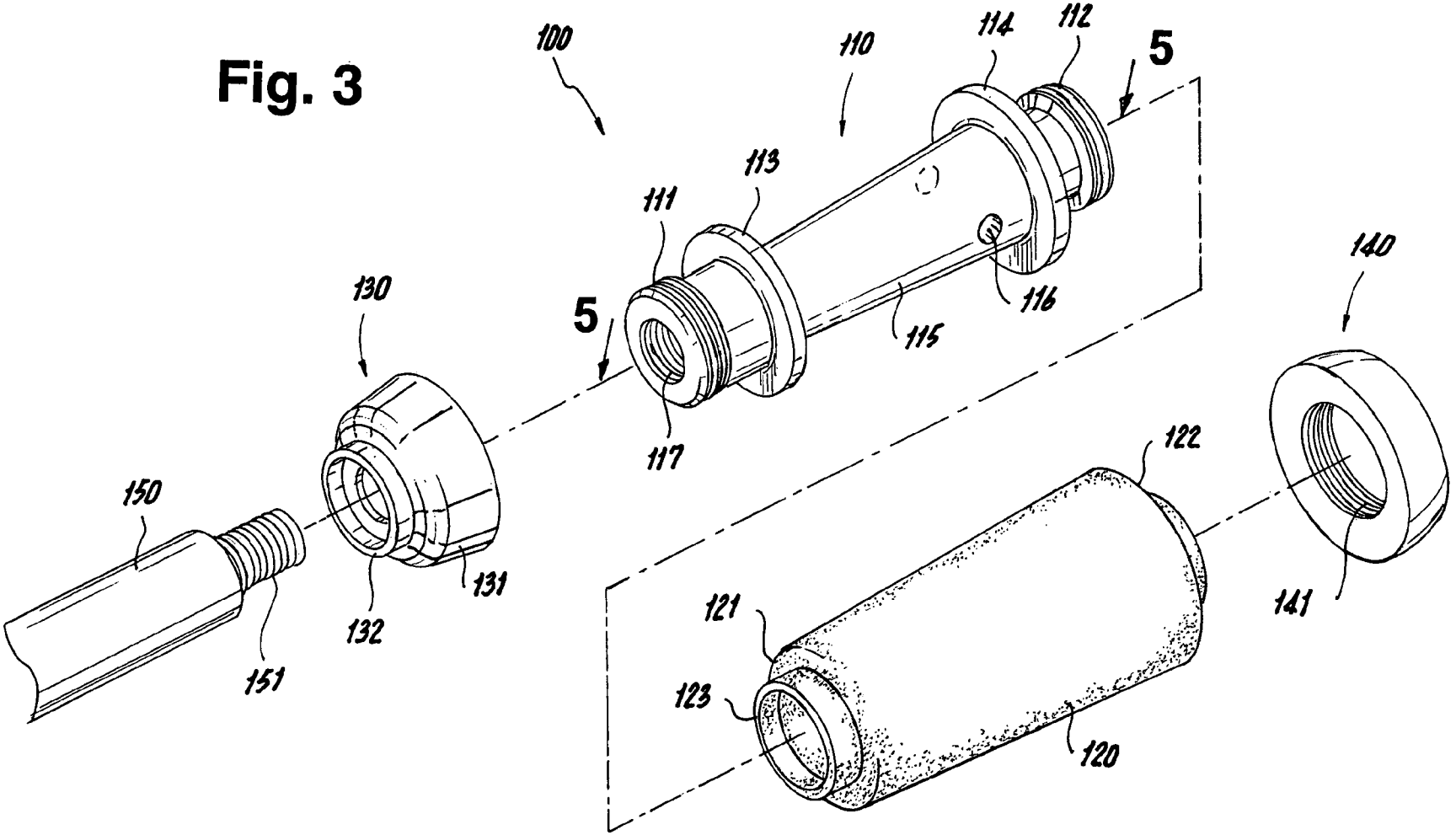
FIG. 3 is a front exploded perspective view of the pliable handle of FIG. 1.
Figure 4:
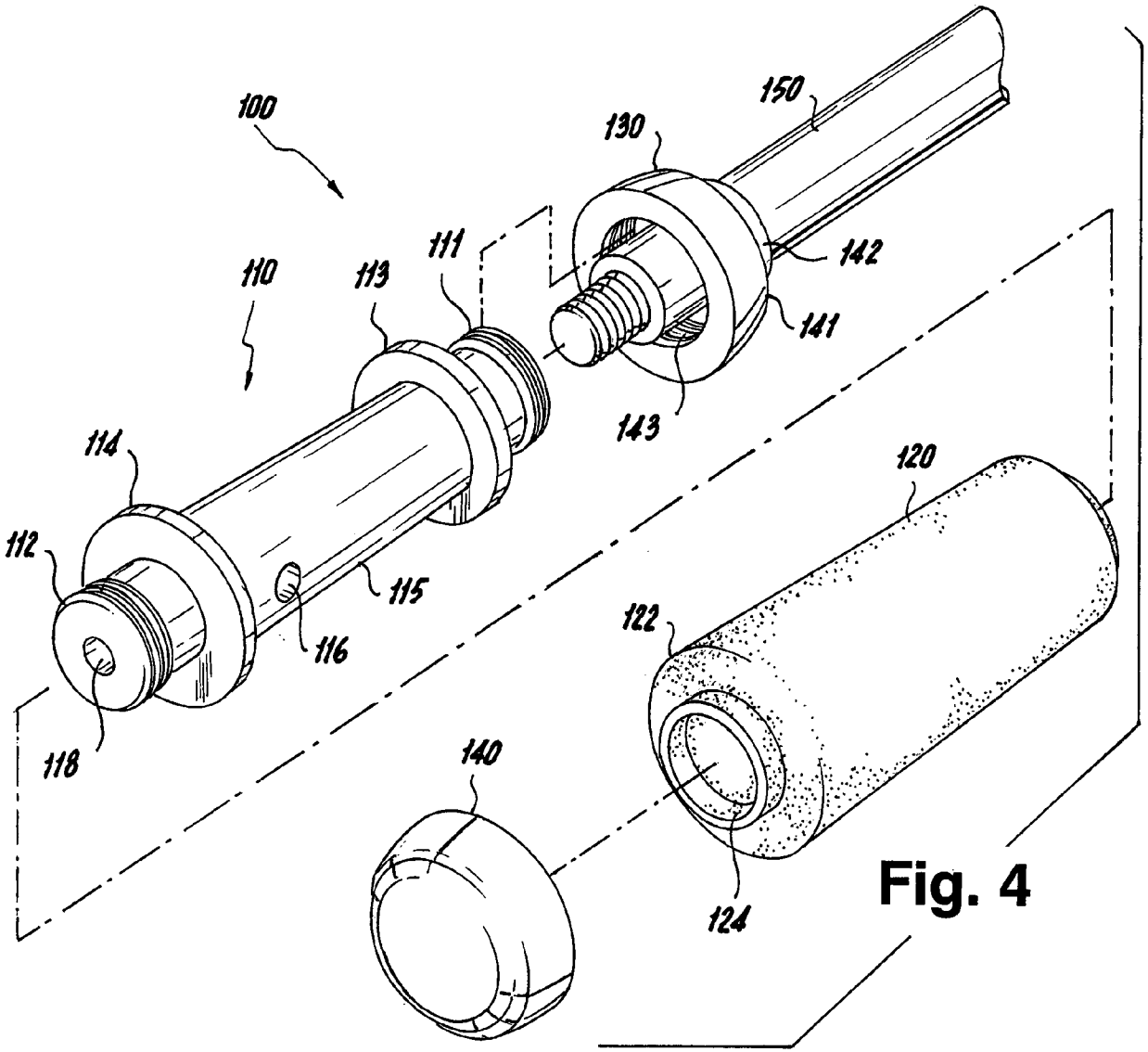
FIG. 4 is a rear exploded perspective view of the pliable handle of FIG. 1.

FIG. 3 is a front exploded perspective view of the pliable handle 100, and FIG. 4 is a rear exploded perspective view of the pliable handle 100. The pliable handle 100 is configured to be securely yet removably attached to a pole 150 (which is not part of the present invention) and is generally formed of a core member 110, an outer sheath 120, a proximal end cap 130, and a distal end cap 140.

One exemplary core member 110 is formed in a substantially cylindrical shape (but can be any other suitable shape) with proximal and distal threaded portions 111, 112 formed on an outer surface of proximal and distal ends, respectively. Proximal and distal annular flanges 113, 114, which partially define a gel-containing portion 115 therebetween, are provided on the outer surface of the core member 110 at a location slightly inward along the longitudinal axis of the core member 110 from the respective proximal and distal threaded portions 111, 112. The diameters of the proximal and distal annular flanges 113, 114 can be the same or different, depending on the desired shape of the pliable handle 100. A gel-directing through bore 116 is formed through the core member 110 at a position closer to the distal threaded portion 112 than the proximal threaded portion 111, and the longitudinal axis of the gel-directing through bore 116 is substantially perpendicular to the longitudinal axis of the core member 110. In other words, the gel-directing through bore 116 is formed proximate the distal annular flange 114 and within the gel-containing portion 115. It is appreciated by those skilled in the art that the position and size of the gel-directing through bore 116 may be modified provided that the modification results in a gel-directing through bore suitable for the intended purpose. A threaded bore 117 is formed in the proximal end of the core member 110 and is designed to threadingly mate with the pole 150 or other device to which the pliable handle of the present invention may be attached. Alternatively, the handle 100 may be designed to be attached to the pole 150 or other device by any other suitable attaching means, such as rivets, adhesive, tension fit, etc.

Figure 5:
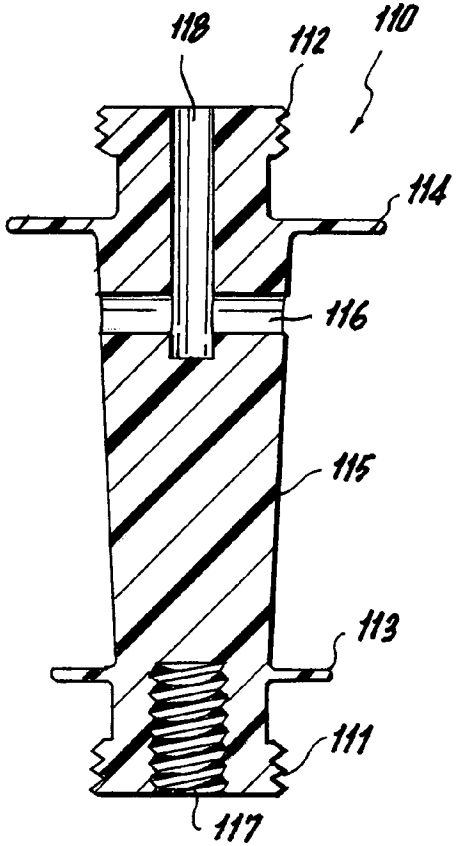
FIG. 5 is a cross-sectional view of the core member taken along line 5—5 of FIG. 3.

FIG. 5 illustrates a cross-sectional view of the core member 110 taken along the line 5—5 of FIG. 3. The core member 110 has formed therein a gel injection bore 118, which is open at the distal end of the core member 110 and is in communication with the through bore 116. In one embodiment, the gel injection bore 118 intersects the through bore 116 at approximately the center thereof. The longitudinal axis of the gel injection bore 118 is substantially perpendicular to the longitudinal axis of the through bore 116. As will be described in detail further below, the gel injection bore 118 and through bore 116 are used to receive and direct gel during the handle assembly process. It is appreciated by those skilled in the art that the number, positions and sizes of these bores may be modified provided that the modification results in bores that are suitable for the intended purpose. The core member 110 can be formed of PVC, ABS, PE or PP plastic, or any other suitable material.

Referring again to FIGS. 3 and 4, the outer sheath 120 is provided over the core member 110 such that the sheath is uniformly disposed about the core member 110. Together the outer sheath 120 and the core member 110 define the gel-containing portion 115 therebetween. That is, the gel-containing portion 115 is defined at its ends by the proximal and distal annular flanges 113, 114 of the core member 110, and at its longitudinal faces by the base of the core member 110 and the outer sheath 120.

The outer sheath 120 is substantially cylindrical in shape and has at its ends a proximal shoulder 121 and a distal shoulder 122, respectively, which may or may not be flanged. The diameter of each of the proximal and distal shoulders 121, 122 corresponds with the diameter of the respective proximal and distal annular flanges 113, 114 of the core member 110, such that when the pliable handle 100 is assembled, the proximal and distal shoulders 121, 122 form gel seals with the proximal and distal annular flanges 113, 114, respectively, due to the intimate fit between these members. Finally, proximal and distal annular lips (rings) 123, 124 define holes provided at the proximal and distal ends, respectively, of the outer sheath 120. When the pliable handle 100 is assembled, the proximal and distal threaded portions 111, 112 of the core member 110 project through the holes defined by the annular lips 123, 124, respectively.

In one preferred embodiment, the outer sheath 120 is formed of vulcanized silicone. Alternatively, the outer sheath 120 may be formed of any other deformable material suitable for the intended purpose. The sheath 120 has a thickness that is great enough to resist breakage, but thin enough to be pliable and readily deformable under the normal handling of a user. Also, the sheath 120 may be colorless, or alternatively may be formed of any of a number of different colors, including a solid color or a multicolored pattern. The sheath 120 may also be transparent or alternatively, opaque. Moreover, the sheath 120 can contain a decorative pattern or other indicia, such as a company logo.

Distal end cap 140 is circular in shape and has an outer diameter that is substantially similar to the diameter of the shoulder 122 of the distal end portion of the outer sheath 120. The bottom end cap 140 has an open end and a closed end. Formed in the open end is a threaded bore 141 designed to secure the cap 140 to the distal threaded portion 112 of the core member 110.

Proximal end cap 130 is circular in shape and has two open ends. The proximal open end of the cap 130 has a shoulder 131. An annular lip 132, which has a diameter that is smaller than that of the shoulder 131, defines a hole and is located concentric with the shoulder 131. The diameter of the distal end of the proximal end cap 130 is larger than the diameter of the proximal end, and is substantially similar to the diameter of the proximal shoulder 121 of the outer sheath 120. Formed in the inner circumference of the distal open end of the proximal end cap 130 are threaded bores 131 designed to secure the cap 130 to the proximal threaded portion 111 of the core member 110.

After assembly, the pliable handle 100 can be secured to a device, such as pole 150 having a threaded end 151. The threaded end 151 is passed through the proximal end cap 130 hole defined by the annular lip 132 and through the outer sheath 120 hole defined by the proximal annular lip 123, and then the threaded end 151 of the pole 150 is screwed into the threaded bore 117 formed in the proximal end of the core member 110.

The distal end cap 140 and proximal end cap 130 may be modified in shape, color, or size, provided that the caps are suitable for their intended purpose. The caps 140, 130 may be made of ABS plastic or any other suitable material. Also, the caps 140, 130 may be colorless, or alternatively may be formed of any of a number of different colors, including a solid color or a multicolored pattern. The caps 140, 130 may also be transparent or alternatively, opaque. It should also be noted that the components of the handle may be modified such that the caps 140, 130 are secured to the handle by a means other than screwing.

One exemplary method for assembling the pliable handle 100 will now be described with reference to FIG. 6, which is a cross-sectional view of the assembled pliable handle 100 illustrating movement of gel during injection.

During assembly, the outer sheath 120 is placed over the core member 110 such that the proximal and distal threaded portions 111, 112 of the core member 110 project through the holes defined by the annular lips 123, 124, respectively of the outer sheath 120. Gel seals are formed by the proximal and distal shoulders 121, 122 of the outer sheath 120 coupling with the respective shoulders 113, 114 of the core member 110. The gel-containing portion 115 is thereby defined at its ends by the proximal and distal annular flanges 113, 114 of the core member 110, and at its longitudinal faces by the base of the core member 110 and the outer sheath 120.

After the outer sheath 120 is placed over the core member 110, gel 700 is injected through the gel injection bore 118 of the core member 110 using an injection nozzle 600. The gel 700 travels through the gel injection bore 118 until it is forced through the gel-directing through bore 116 in a direction perpendicular to its original traveling direction and then into the gel-containing portion 115 so that the gel 700 is uniformly disposed about the core member 110. When the gel-containing portion 115 is filled with gel 700, the injection nozzle 600 is removed and the proximal and distal end caps 130, 140 are secured to the proximal and distal threaded portions 111, 112 of the core member 110. That is, the proximal end cap 130 is secured to the proximal threaded portion of the 111 of the core member 110, and the distal end cap 140 is secured to the distal threaded portion 112 of the core member 110. Cap 140 seals the bore 118. Alternatively, a plug may be used to seal the bore 118. At this point the pliable handle 100 is completely assembled and ready to be secured to a device, such as the pole 150 of an umbrella, a handle of any one of a cane, walking stick, sports equipment (e.g., baseball bat, golf club, tennis racket, fishing rod, hockey stick, etc.), tool (e.g., screwdriver, hammer, etc.), garden equipment (e.g., shovel, rake, shears, etc.), kitchen tool (e.g., knife, pot, pan, can opener, etc.), cleaning equipment (e.g., broom, mop, etc.), writing instruments, beauty equipment (e.g., cosmetic applicators, curling irons, hair dryers, etc.), etc.

FIG. 7 is a cross-sectional view of the assembled pliable handle 100 illustrating movement of gel 700 while a force exerting pressure is applied to the handle 100. As a hand grips the pliable handle 100, force is applied in directions indicated by the arrows to cause the outer sheath 120 and gel 700 to deform. As indicated by the arrows, the gel 700 is forced in multiple directions. As mentioned above, the pliable handle has memory effect, such that after the force exerting pressure is removed, the deformation in the handle will remain for a period of time before the handle returns to its original shape.

The gel 700 may be formed of silicone or any other suitable material. The gel 700 may be colorless, or alternatively may be formed of any of a number of different colors, including a solid color or a multicolored (e.g., speckled) pattern. The gel 700 may also be transparent or alternatively, opaque.

Figure 8:
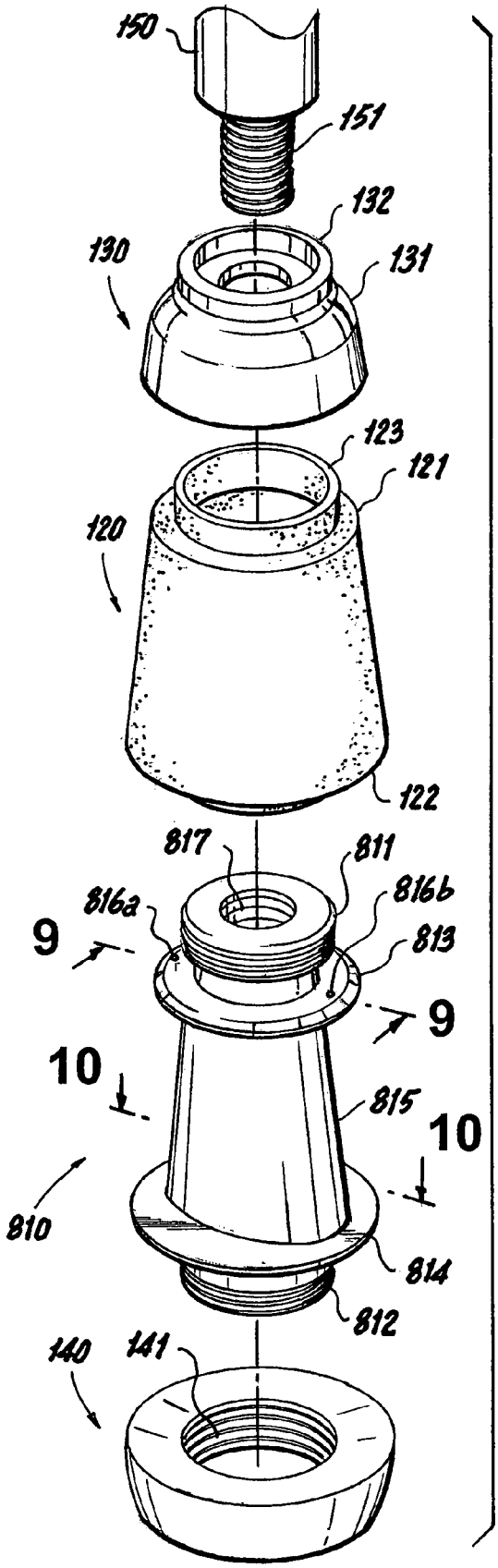
FIG. 8 is a front exploded perspective view of a second exemplary embodiment of the pliable handle having an alternate method for gel injection.

FIG. 8 is a front exploded perspective view of a second exemplary embodiment of the pliable handle according to the present invention having an alternate method for gel injection. Like the pliable handle 100 of the first exemplary embodiment shown in FIGS. 3–7, pliable handle 800 is configured to be securely yet removably attached to a pole 150 (which is not part of the present invention) and is generally formed of a core member 810, an outer sheath 120, a proximal end cap 130, and a distal end cap 140. Many of the components, such as the outer sheath 120, the proximal end cap 130, and the distal end cap 140 are the same in both of the pliable handles 100, 800 according to the first and second exemplary embodiments, respectively, and thus the same reference numerals have been used. A main difference in structure in the pliable handle according to this second exemplary embodiment is of the inner core 810.

This exemplary core member 810 is formed in a substantially oval shape (and alternatively may be cylindrical or any other suitable shape) with proximal and distal threaded portions 811, 812 formed on an outer surface of proximal and distal ends, respectively. Proximal and distal annular flanges 813, 814, which partially define a gel-containing portion 815 therebetween, are provided on the outer surface of the core member 810 at a location slightly inward along the longitudinal axis of the core member 810 from the respective proximal and distal threaded portions 811, 812. Gel injection through bores 816*a*, 816*b* are formed through the proximal annular flange 813 on opposing sides of the flange 813 and such that the longitudinal axes of the gel injection through bores 816*a*, 816*b* are substantially parallel to the longitudinal axis of the core member 810. A threaded bore 817 is formed in the proximal end of the core member 810 and is designed to threadingly mate with the pole 150 or other device to which the pliable handle of the present invention may be attached.

Figure 9:
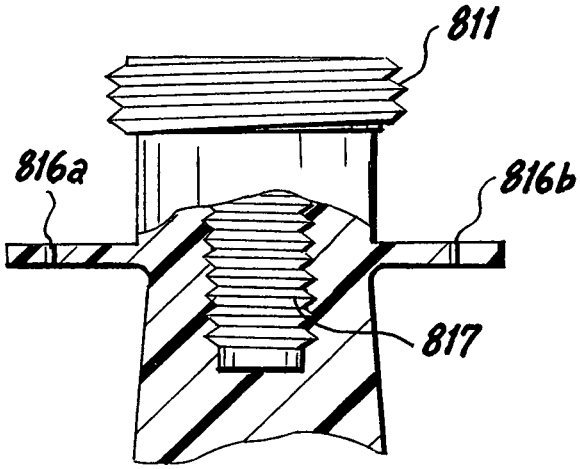
FIG. 9 is an elevational view of the core member in partial cutaway taken along line 9—9 of FIG. 8.
Figure 10:
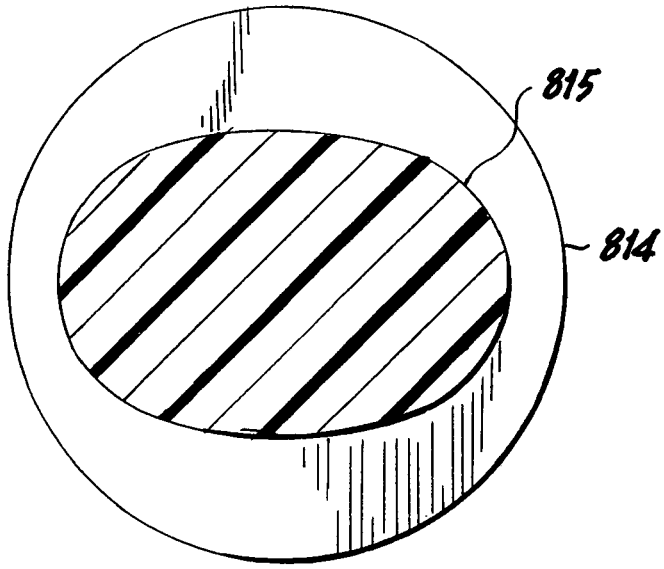
FIG. 10 is a sectional plan view of the core member taken along line 10—10 of FIG. 8.

FIG. 9 is an elevational view of the core member in partial cutaway taken along line 9—9 of FIG. 8, and FIG. 10 is a sectional plan view of the core member taken along line 10—10 of FIG. 8. The core member 810 has formed therein the gel injection through bores 816*a*, 816*b* and threaded bore 817 as described in the previous paragraph. As will be described in detail further below, the gel injection though bores 816*a*, 816*b* are designed to receive gel and exhaust air, respectively, during the handle assembly process. It is appreciated by those skilled in the art that the number, positions and sizes of the gel injection through bores 816*a*, 816*b* can be modified provided that the modification results in bores that are suitable for the intended purpose. The core member 810 can be formed of PVC, ABS, PE or PP plastic, or any other suitable material.

Figure 11:
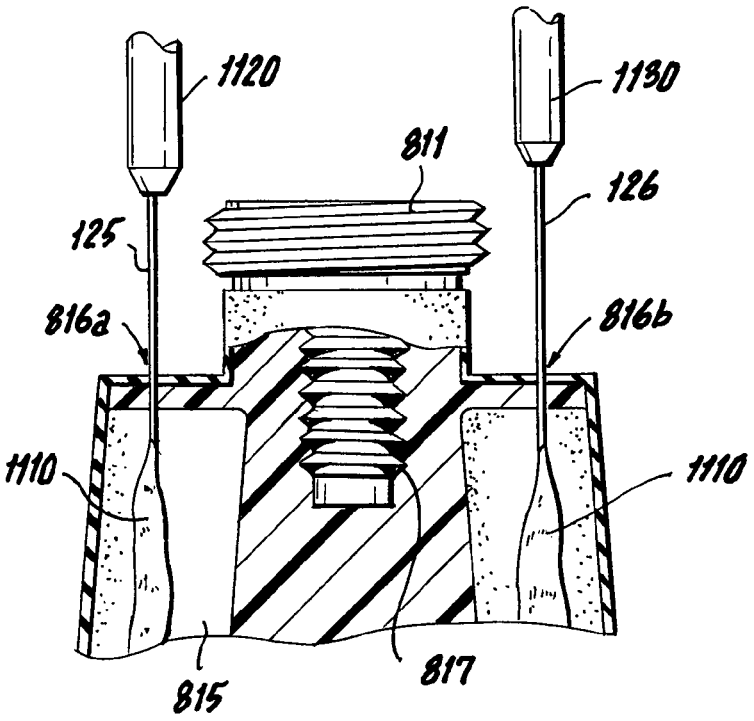
FIG. 11 is an elevational view in partial cutaway of the assembled pliable handle of FIG. 8 having two gel injection bores and illustrating movement of gel during injection.

An exemplary method for assembling the pliable handle 800 will now be described with reference to FIG. 11, which is an elevational view in partial cutaway of the assembled pliable handle 800 of FIG. 8 illustrating movement of gel 1100 during injection.

During assembly, the outer sheath 120 is placed over the core member 810 such that the proximal and distal threaded portions 811, 812 of the core member 810 project through the holes defined by the annular lips 123, 124, respectively of the outer sheath 120. Gel seals are formed by the proximal and distal shoulders 121, 122 of the outer sheath 120 coupling with the respective shoulders 813, 814 of the core member 810. The gel-containing portion 815 is thereby defined at its ends by the proximal and distal annular flanges 813, 814 of the core member 810, and at its longitudinal faces by the base of the core member 810 and the outer sheath 120.

After the outer sheath 120 is placed over the core member 810, holes 125, 126 are pierced through the outer sheath 120 to correspond with gel injection through bores 816*a*, 816*b*, respectively. As shown in FIG. 11, gel 1110 is injected through both of gel injection through bores 816*a* and 816*b* of the core member 810 using injection needles 1120 and 1130, respectively. Gel 1110 travels through the gel injection though bores 816*a*, 816*b* and fills the gel-containing portion 815 so that the gel 1110 is uniformly disposed about the core member 810. When the gel-containing portion 815 is filled with gel 1110, the injection needles 1120, 1130 are removed and the proximal and distal end caps 130, 140 are secured to the proximal and distal threaded portions 811, 812 of the core member 810. That is, the proximal end cap 130 is secured to the proximal threaded portion of the 811 of the core member 810, and the distal end cap 140 is secured to the distal threaded portion 812 of the core member 110. Cap 130 seals the gel injection bores 816*a*, 816*b*. Also, plugs

Figure 12:
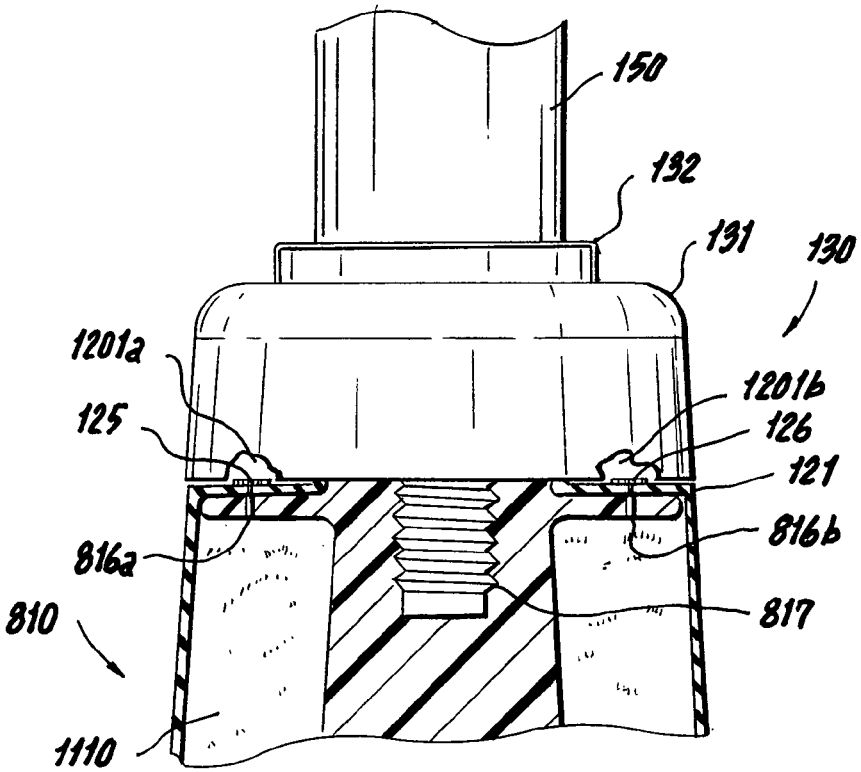
FIG. 12 is an elevational view in partial cutaway of the assembled, gel-filled pliable handle of FIG. 8.

1201*a*, 1201*b* may be used to plug the gel injection through bores 816*a* and 816*b* before the cap 130 is secured so as to minimize the risk of any gel leaks; the plugs 1201*a*, 1201*b* may be made of any material or shape (e.g., screws set with epoxy glue) suitable for the intended purpose. At this point the pliable handle 800 is completely assembled and ready to be secured to a device, as shown in FIG. 12.

Figure 13:
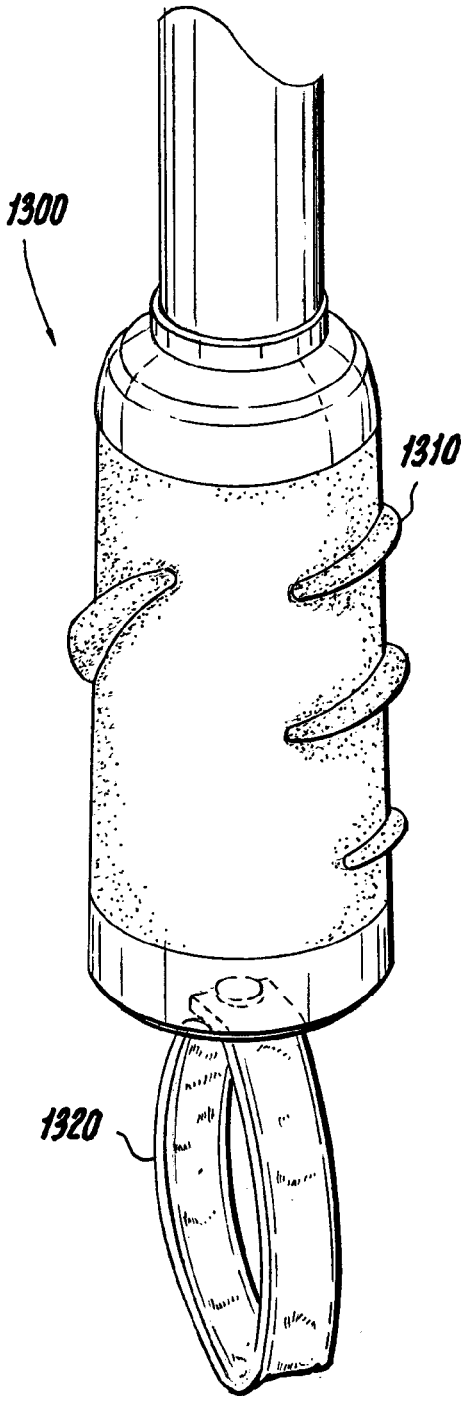
FIG. 13 is a perspective view of a third exemplary embodiment of the pliable handle having a modified sheath and a loop for hanging.

FIG. 13 is a perspective view of a third exemplary embodiment of the pliable handle according to the present invention. In this embodiment, the outer sheath 120 is modified to form ribs 1310 thereon. The ribs 1310 are sized and spaced such that fingers may be placed comfortably within the spaces between the ribs 1310. Aside from better comfort, the ribs 1310 provide a more secure grip to thereby prevent loss of the handle 1300 along with the device to which it is attached. Alternatively, the ribs 1310 may be spaced closer together, that is, closer that the width of the fingers, so as to merely provide better friction for gripping. Preferably, the ribs 1310 are made of the same material as the outer sheath 120, but the ribs 1310 may be made of any other suitable material.

Further, a loop (or wrist strap) 1320 may be provided on the closed end of the distal end cap 140. Alternatively, the loop 1320 may be secured to the proximal end cap 130, between the pole 150 and the proximal end cap 130, or any other position suitable for its intended purpose. This loop 1320 may be used for hanging the handle along with the device to which it is attached, or for securing the handle and corresponding device to a wrist. The loop 1320 may be made of plastic or any other suitable material.

Figure 14:
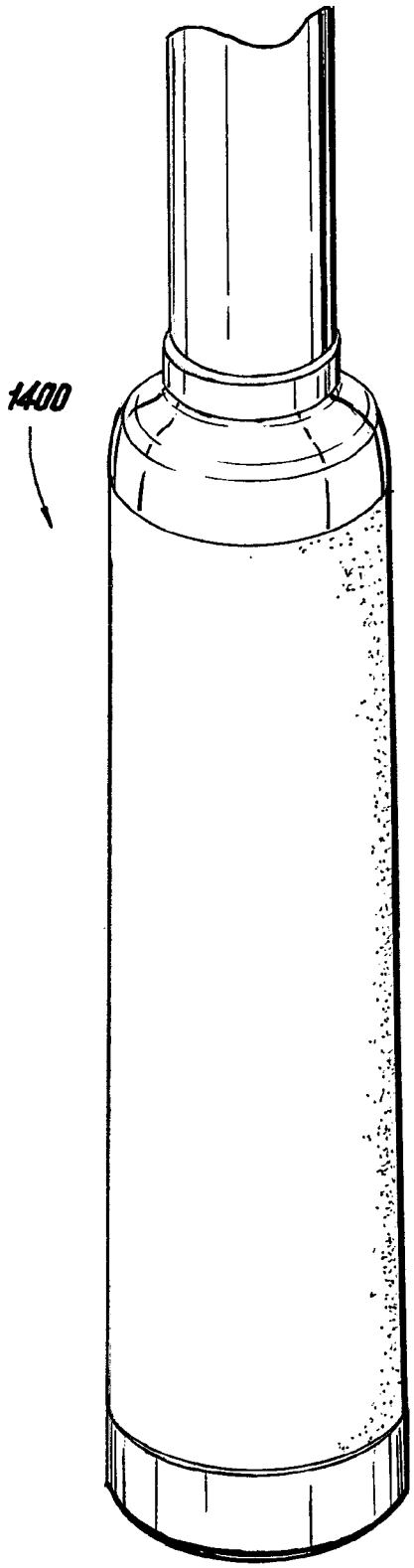
FIG. 14 is a perspective view of a fourth exemplary embodiment of the pliable handle elongated for two-handed gripping.

FIG. 14 is a perspective view of a fourth exemplary embodiment of the pliable handle of the present invention. The pliable handle 1400 of this embodiment is elongated for two-handed gripping.

Figure 15:
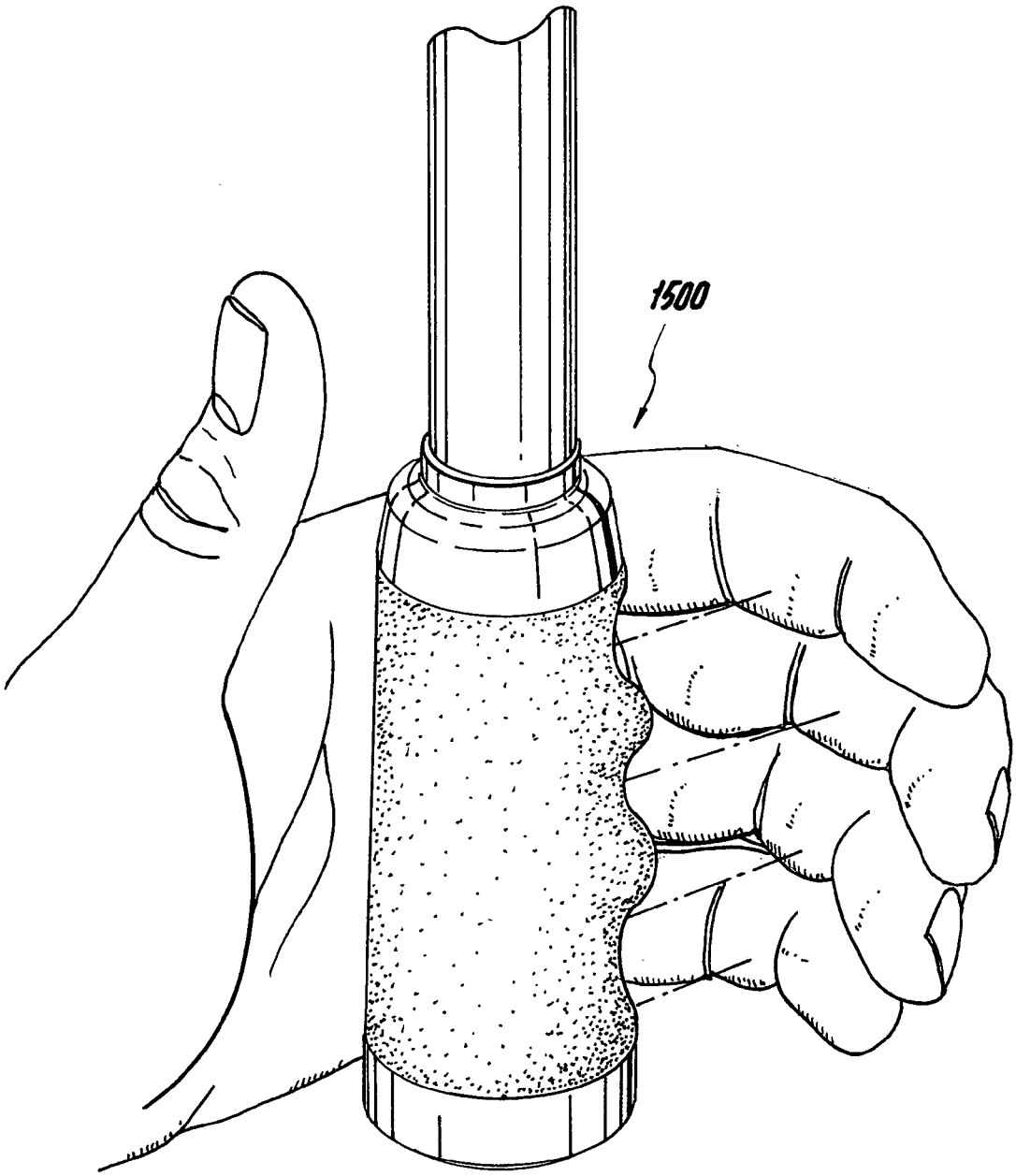
FIG. 15 is a perspective view of a fifth exemplary embodiment of the pliable handle having a contoured shape.

FIG. 15 is a perspective view of a fifth exemplary embodiment of the pliable handle of the present invention. The sheath of the pliable handle 1500 of this embodiment has a shape contoured to fit a hand. The inner core may have substantially the same shape as one of the shapes of the inner cores described above or any other modified shape that would be suitable for the intended purpose. Pliable handle 1700 may also include a loop like the one shown in FIG. 13.

Figure 16:
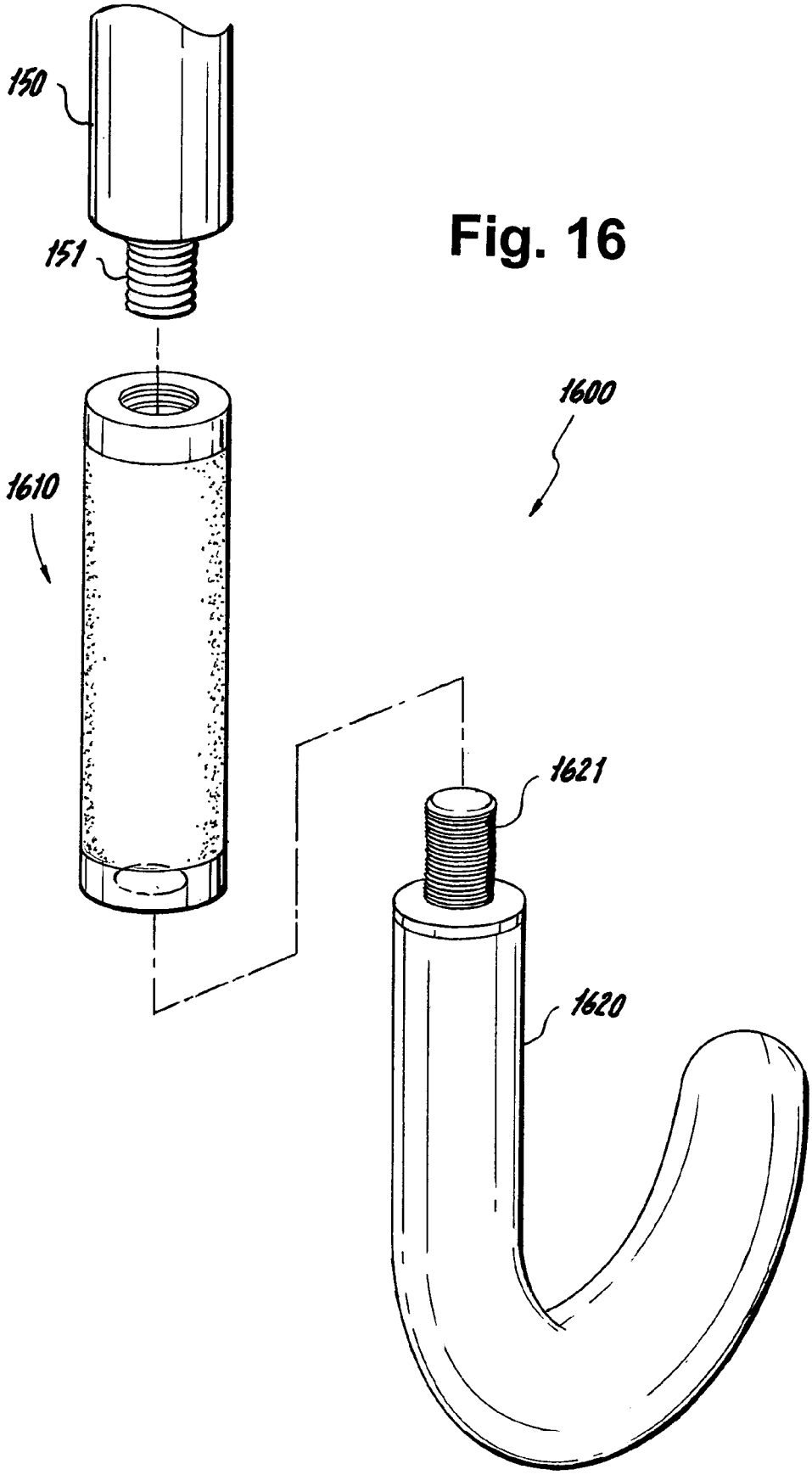
FIG. 16 is an exploded perspective view of a sixth exemplary embodiment of the pliable handle applied to an umbrella with a curved handle portion.

FIG. 16 is an exploded perspective view of a sixth exemplary embodiment of the pliable handle of the present invention. The pliable handle 1600 has a pliable gripping portion 1610 similar in construction to the other handles described throughout this description, and thus descriptions of its features will not be repeated here. A main difference in pliable handle 1600 is that at the distal end, rather than being attached to a distal end cap, as described above, it is attached to a curved handle portion 1620. That is, a threaded end 1621 of the curved handle portion 1620 is threadingly mated with a threaded bore (not shown) formed in the distal end portion of the pliable gripping portion 1610.

Figure 17:
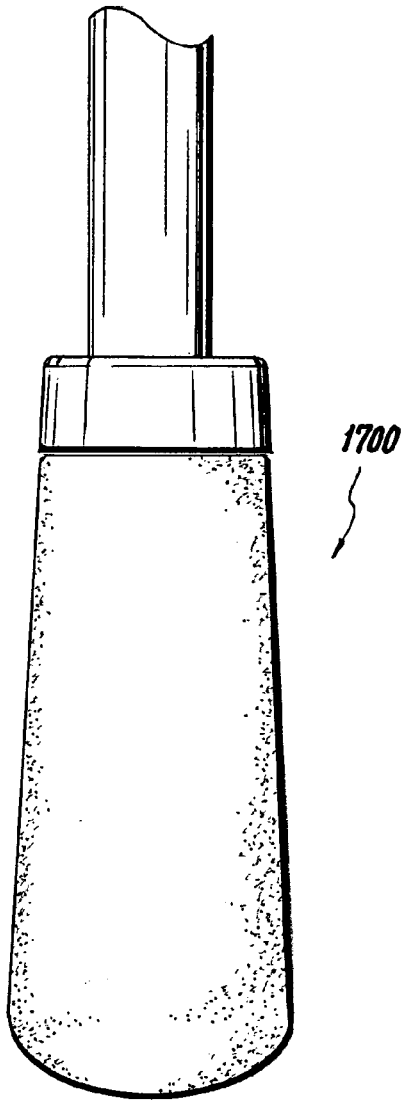
FIG. 17 is a perspective view of a seventh exemplary embodiment of the pliable handle having no distal end cap.

FIG. 17 is a perspective view of a seventh exemplary embodiment of the pliable handle of the present invention. The pliable handle 1700 is similar in construction to the other handles described throughout this description. However, pliable handle 1700 does not have end caps, the inner core has a dome-shaped portion, and the outer sheath has a closed end. A more detailed explanation follows.

Figure 18:
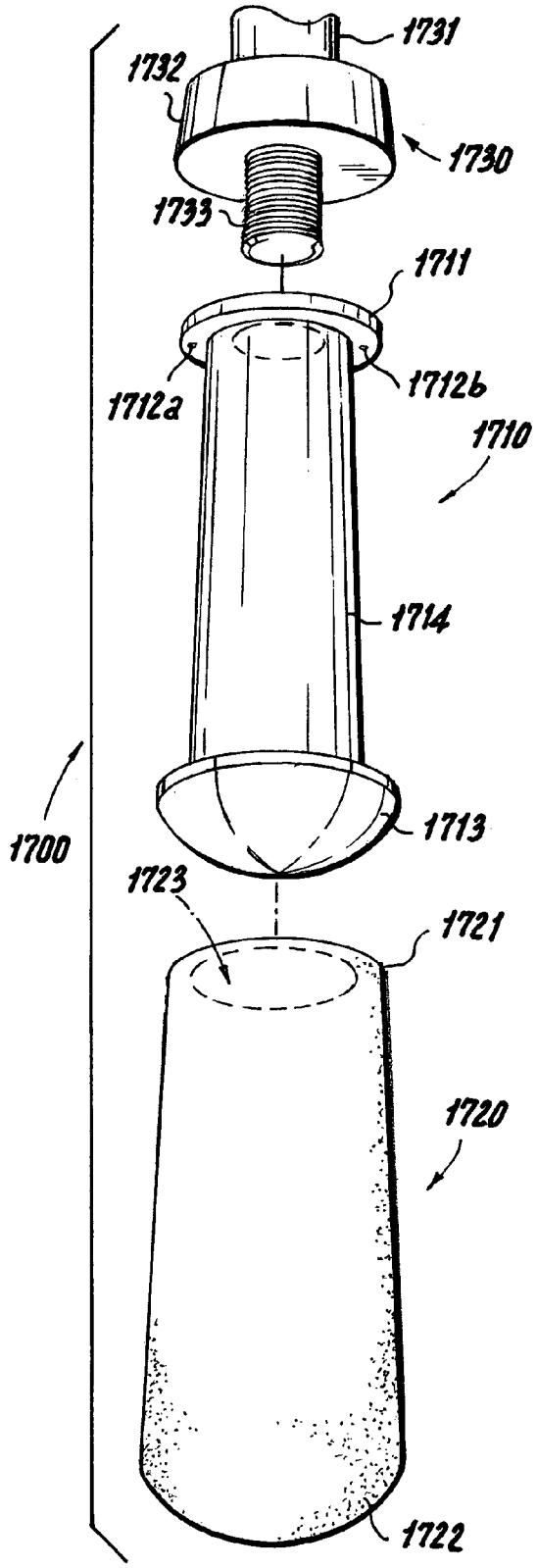
FIG. 18 is an exploded perspective view of the pliable handle of FIG. 17.

FIG. 18 is an exploded perspective view of the pliable handle of FIG. 17. The pliable handle 1700 is configured to be securely yet removably attached to a pole portion 1730 and is generally formed of a core member 1710 and an outer sheath 1720.

One exemplary core member 1710 is formed in a substantially cylindrical shape (but can be any other suitable shape) with a distal dome-shaped portion 1713. An annular flange 1711, which with the dome-shaped portion 1713 partially defines a gel-containing portion 1714 therebetween, is provided on the outer surface of the core member 1710 at the proximal end of the core member 1710. Gel injection through bores 1712*a*, 1712*b*, which are similar to gel injection through bores 816*a* and 816*b* shown in FIG. 8, are formed through the annular flange 1711 on opposing sides of the flange 1711 and such that the longitudinal axes of the gel injection through bores 1712*a*, 1712*b* are substantially parallel to the longitudinal axis of the core member 1710. A threaded bore (not shown) is formed in the proximal end of the core member 1710 and is designed to threadingly mate with the pole portion 1730 or other device to which the pliable handle of the present invention may be attached.

The outer sheath 1720 is provided over the core member 1710 such that the sheath is uniformly disposed about the core member 1710. Together the outer sheath 1720 and the core member 1710 define the gel-containing portion 1714 therebetween. That is, the gel-containing portion 1714 is defined at its ends by the annular flange 1711 and the dome-shaped portion 1713 of the core member 1710, and at its longitudinal faces by the base of the core member 1710 and the outer sheath 1720.

The outer sheath 1720 is substantially cylindrical in shape and has a proximal open end 1721 having a shoulder defining a hole 1723 and a distal closed end 1722. The diameter of the shoulder of the proximal open end 1721 corresponds with the diameter of the annular flange 1711 of the core member 1710, such that when the pliable handle 1700 is assembled, the shoulder at the proximal open end 1721 forms a gel seal with the annular flange 1711 due to the intimate fit between these members.

After assembly, the pliable handle 1700 can be secured to a device, such as pole portion 1730 having a threaded end 1733 and an annular flange 1732 provided on the outer surface of the pole 1731 of the pole portion 1730 at a location adjacent to the threaded end 1733. The diameter of the annular flange 1732 is preferably, but not necessarily, the same as the diameter of the annular flange 1711 of the core member 1710. The threaded end 1733 is screwed into the threaded bore (not shown) formed in the proximal end of the core member 1710.

Figure 19:
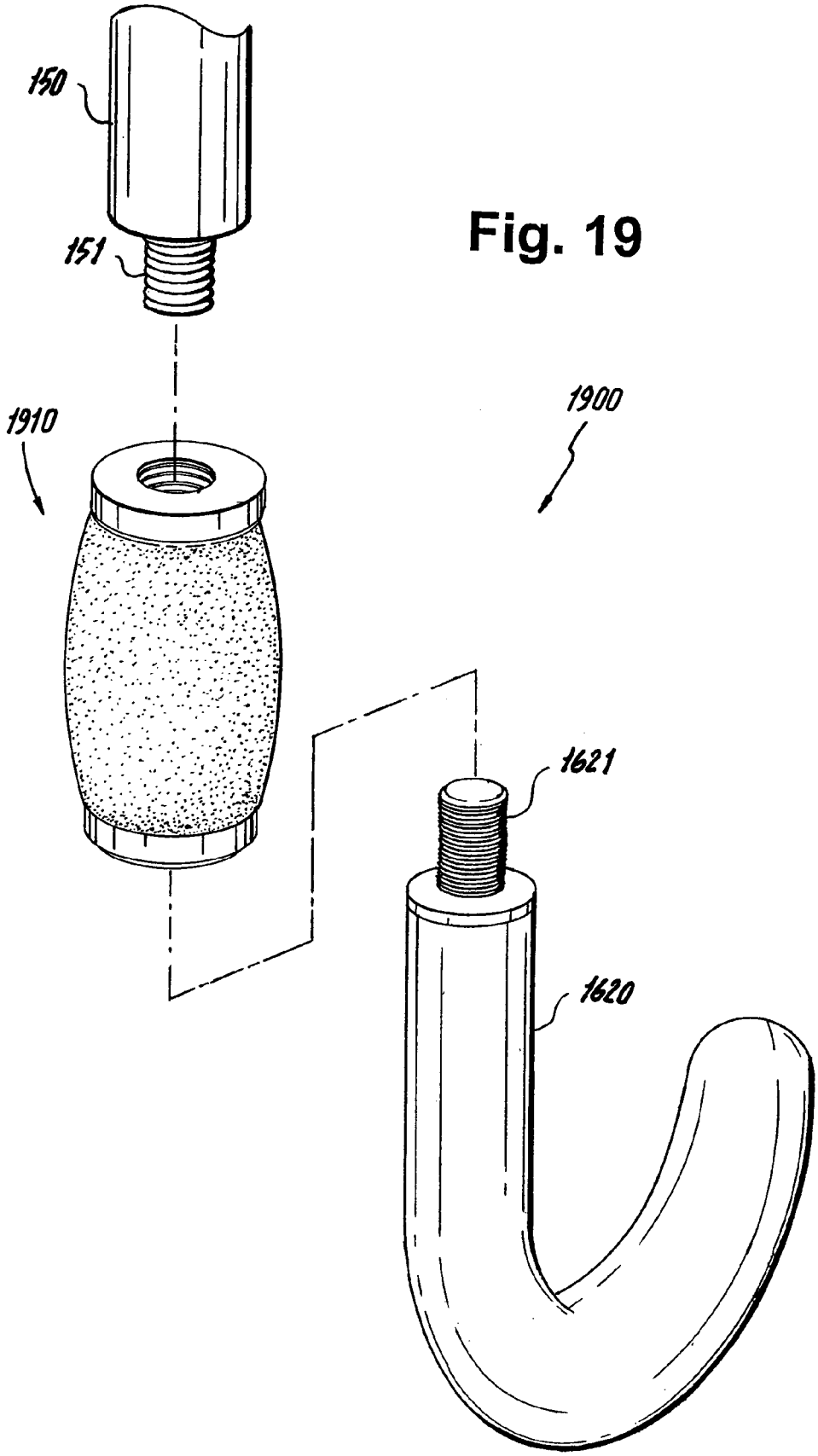
FIG. 19 is an exploded perspective view of an eighth exemplary embodiment of the pliable handle having an alternative core member.

FIG. 19 is an exploded perspective view of an eighth exemplary embodiment of the pliable handle having an alternative core member. The pliable handle 1900 has a pliable gripping portion 1910. A main difference in the pliable gripping portion 1910 of the pliable handle 1900 is that the core member (described in detail below) is of three-part construction. Similar to the pliable gripping portion 1610 of FIG. 16, this pliable gripping portion 1910 is shown attached to a pole 150 at the proximal end and to a curved handle portion 1620 at the distal end. It is understood, however, that the pliable gripping portion 1910 need not be applied to a pole 150 or a curved handle portion 1620, but may alternatively be applied to any other device suitable for the intended purpose.

Figure 20:
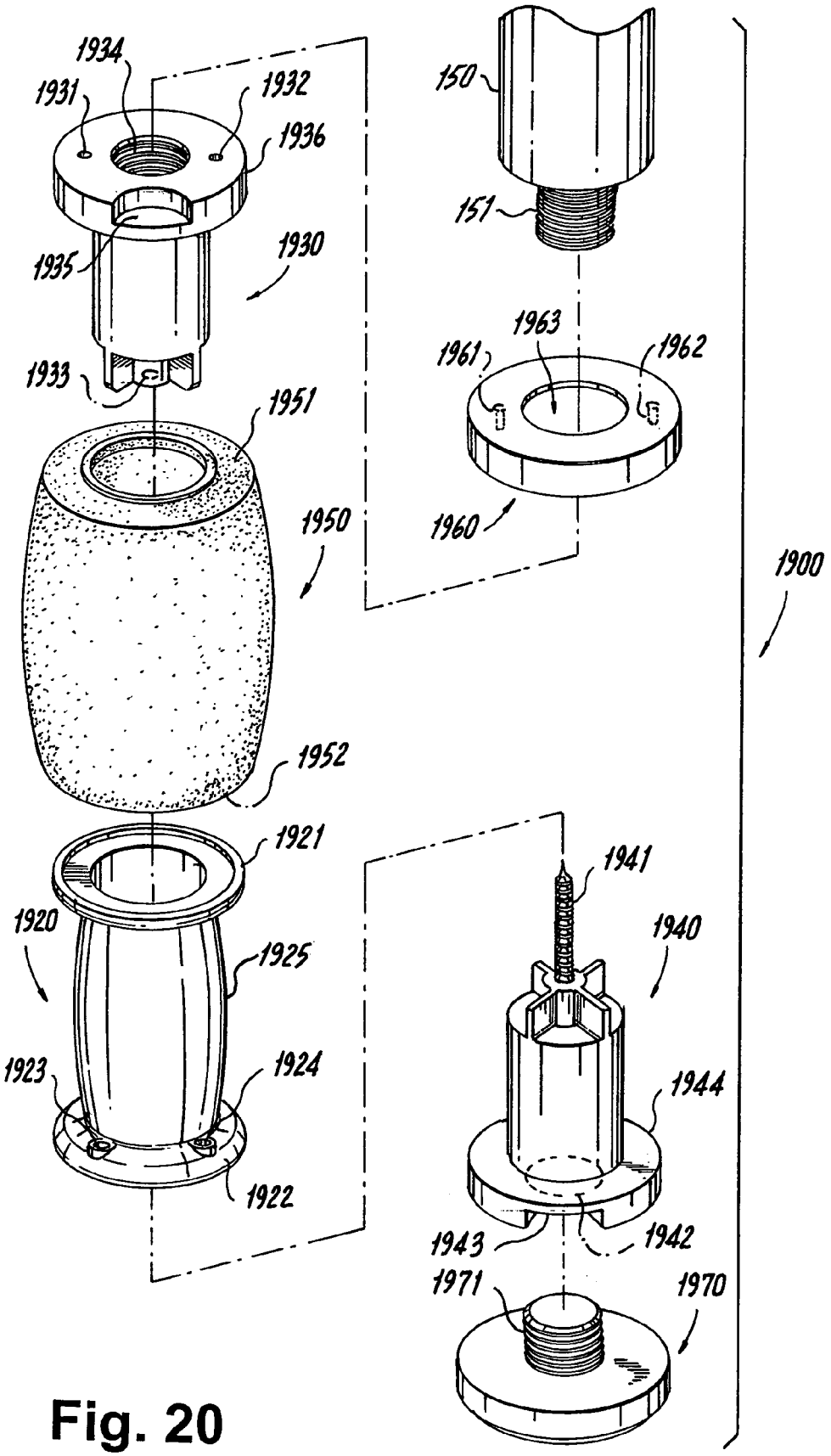
FIG. 20 is a front exploded perspective view of the pliable handle of FIG. 19.

FIG. 20 is a front exploded perspective view of the pliable handle of FIG. 19 having the alternative core member consisting of three parts. The exemplary three-part core member is formed of a main core member part 1920, a proximal sealer 1930, and a distal sealer 1940. The core member main part 1920 is substantially tubular in shape with an annular flange 1921 at the proximal end and an annular flange 1922 at the distal end. The proximal and distal annular flanges 1921, 1922 partially define a gel-containing portion 1925 therebetween. The distal flange 1922 has formed therein four gel injection bores, only two of which (1923 and 1924) are shown, such that the longitudinal axes of the gel injection bores 1923, 1924 are substantially parallel to the longitudinal axis of the core member main part 1920 and are spaced apart from one another. It is understood that although four gel injection bores are shown, there may be any number of gel injection bores suitable for the intended purpose. Also, these gel injection bores may alternatively be formed in the proximal annular flange 1921.

The distal sealer 1940 is substantially cylindrical in shape with an annular flange 1944 at one end. Formed in the annular flange 1944 is a threaded bore 1942, though this bore 1942 is not essential to the invention. Formed in the opposite end along the central axis of the distal sealer 1940 is a screw 1941 that projects from the distal sealer 1940. The distal sealer 1940 is shown having in the annular flange 1944 a semicircular notch 1943, which is intended to allow for a handle strap. However, this notch 1943 is not required, and a strap could be secured in the center of the annular flange 1944 rather than the side.

The proximal sealer 1930 is also substantially cylindrical in shape with an annular flange 1936 having a threaded bore 1934 and a semicircular notch 1935 formed in one end. Formed in the opposite end is a hole 1933, which is designed to mate with the screw 1941 of the distal sealer 1940.

The proximal sealer 1930 and distal sealer 1940 are designed to be inserted at opposite ends of the core member main part 1920 and screwingly mated together within the core member main part 1920. More specifically, after the proximal and distal sealers 1930, 1940 are inserted into the tubular portion of the core member main part 1920 at opposing ends, a screw portion 1941 of the distal sealer 1940 is inserted into a hole portion 1933 of the proximal sealer 1930 and screwed therein such that the three parts of the core member are coupled together to form a single unit. Of course the screw portion 1941 may be alternatively formed on the proximal sealer 1930 and the hole portion 1933 correspondingly formed in the distal sealer 1940. The sealing affects of the proximal sealer 1930 and distal sealer 1940 will become clear from the description of the assembly process below.

The pliable handle 1900 also includes an outer sheath 1950 that is substantially cylindrical in shape and has at its ends a proximal shoulder 1951 and a distal shoulder 1952, respectively. The diameter of each of the proximal and distal shoulders 1951, 1952 corresponds with the diameter of the respective proximal and distal annular flanges 1921, 1922 of the core member main part 1920.

The pliable handle 1900 may also include a proximal end cap 1960 and a distal end cap 1970. The proximal end cap 1960 has an annular lip 1963, which has a diameter that is smaller than that of the proximal end cap 1960 itself, defines a hole, and is located concentric with the proximal end cap 1960. The diameter of the distal end of the proximal end cap 1960 is substantially similar to the diameter of the proximal shoulder 1951 of the outer sheath 1950. Formed on the distal end or underside of the proximal end cap 1960 may be projections 1961, 1962 designed to secure the proximal end cap 1960 to the proximal end of the proximal sealer 1930 having corresponding bores 1931, 1932 formed therein. It is to be understood, however, that the proximal end cap 1960 is not required.

The distal end cap 1970 has formed in its proximal side along its central axis a threaded projection 1971, which is designed to threadingly mate with the threaded bore 1942 of the distal sealer 1940. It is to be understood, however, that the distal end cap 1970 is not required.

Figure 21:
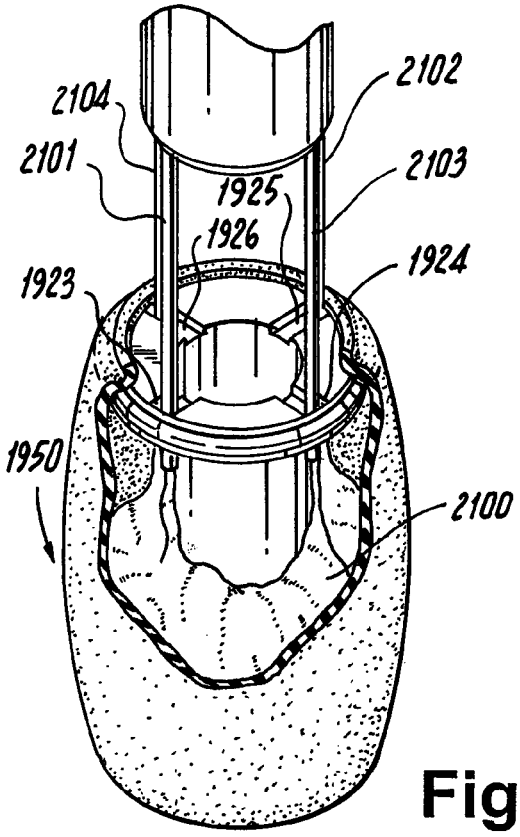
FIG. 21 is a perspective view showing the pliable handle of FIG. 19 in partial cutaway having four gel injection bores and illustrating movement of gel during injection.
Figure 22:
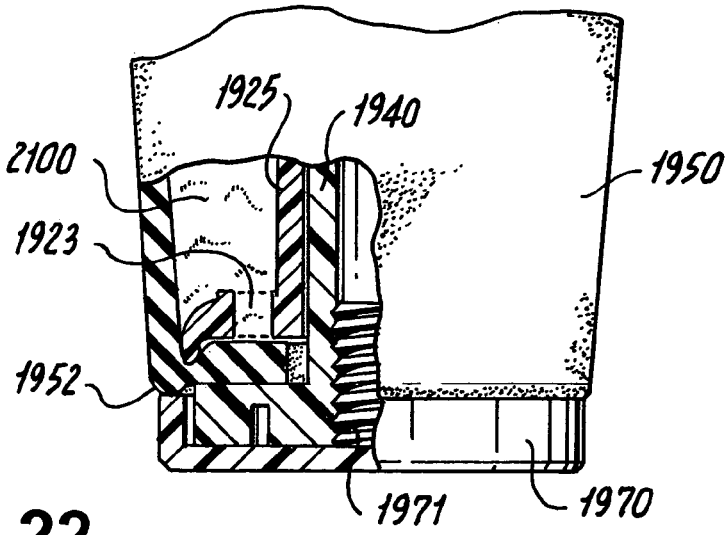
FIG. 22 is a sectional view of the pliable handle of FIG. 19 in partial cutaway illustrating compression on an outer sheath to seal gel injection bores.

The assembly process of the eighth exemplary embodiment will now be described with reference to FIGS. 21 and 22. FIG. 21 is a perspective view showing the pliable handle 1900 in partial cutaway and having four gel injection bores 1923, 1924, 1925, 1926 and illustrating movement of gel 2100 during injection. FIG. 22 is a sectional view of the pliable handle 1900 in partial cutaway illustrating compression of the shoulder 1952 of the outer sheath 1950 to seal the gel injection bores 1923, 1924, 1925, 1926.

During assembly, the outer sheath 1950 is placed over the core member main part 1920 such that the proximal and distal shoulders 1951, 1952 of the outer sheath 1950 grip the respective annular flanges 1921, 1922 of the core member main part 1920. A gel-containing portion 1925 is thereby defined at its ends by the proximal and distal annular flanges 1921, 1922 of the core member main part 1920, and at its longitudinal faces by the base of the core member main body 1920 and the outer sheath 1950.

Referring specifically to FIG. 21, after the outer sheath 1950 is placed over the core member main part 1920, gel 2100 is injected through the four gel injection bores 1923, 1924, 1925, 1926 of the core member main part 1920 using injection nozzles 2101, 2102, 2103, 2104, respectively. The gel 2100 travels through the gel injection bores 1923, 1924, 1925, 1926 to fill the gel-containing portion 1925, and then the injection nozzles 2101, 2102, 2103, 2104 are removed. Again, the specific number of four gel injection bores and four injection nozzles are not required. The number may be any that is suitable for the intended purpose.

Now referring to FIG. 22, the proximal sealer 1930 and distal sealer 1940 are subsequently inserted at opposite ends of the core member main part 1920 and screwingly mated together such that the screw portion 1941 of the distal sealer 1940 is screwed within the hole portion 1931 of the proximal sealer 1930. As the proximal sealer 1930 and distal sealer 1940 are screwed tighter together, the distal shoulder portion 1952 of the outer sheath 1950 is compressed between the distal annular flange 1922 of the core member main part 1920 and the distal sealer 1940, thereby sealing the gel injection bores 1923, 1924, 1925, 1926 formed in the distal annular flange 1922 and securely containing the gel 2100 within the gel-containing portion 1925. Finally, the end caps 1960, 1970 may be secured to the proximal end of the proximal sealer 1930 and the distal end of the distal sealer 1940, respectively.

As may be appreciated, the pliable handle may be formed of any of a number of different sizes and/or shapes, such as curved, straight, contoured, or tapered, so long as the pliable handle is suitable for its intended purpose.

Throughout the description the words "proximal" and "distal" have been used to describe components or portions of components. These words were used merely to aid the reader in an understanding of the invention and are not intended to be limiting.

While this invention has been particularly shown and described with references to preferred embodiments thereof, it will be understood by those skilled in the art that various changes in form and details may be made therein without departing from the scope of the invention encompassed by the appended claims.

What is claimed is:

1. A pliable handle comprising:

a core member having a core member main part and first and second sealers at respective ends of the core member main part, the core member main part having first and second annular flanges, which partially define a gel-containing portion therebetween, provided near respective ends of the core member main part, and at least one gel injection through bore formed through the first annular flange;

an outer sheath disposed about the core member main part; and a gel disposed between the core member main part and the outer sheath;

wherein the outer sheath is deformable, and a force applied to the outer sheath causes load movement of the gel.

2. The pliable handle of claim 1, wherein the first and second sealers are coupled together though the center of the core member main part.

3. The pliable handle of claim 1, wherein the first and second sealers compress a shoulder of the outer sheath between the first annular flange and the first sealer, thereby sealing the bore formed in the first annular flange and securely containing the gel within the gel-containing portion.

4. The pliable handle of claim 2, wherein the first and second sealers are coupled together by a screw projecting from one of the first and second sealers.

5. The pliable handle of claim 1, wherein the deformable outer sheath and gel together have a memory effect causing a deformation to remain for a period of time before the sheath returns substantially to its original shape.

6. The pliable handle of claim 1, wherein the gel is in intimate contact with the core member.

7. The pliable handle of claim 1, further comprising an end cap that is connected to one of the first and second sealers.

8. The pliable handle of claim 7, wherein the outer sheath has at its ends a first shoulder and a second shoulder, respectively, and an outer diameter of the end cap is substantially similar to the diameter of one of the first and second shoulders.

9. The pliable handle of claim 7, wherein the end cap has at a first end a shoulder and a concentric annular lip that defines a hole and has a diameter that is smaller than that of the shoulder.

10. The pliable handle of claim 9, wherein the diameter of a second end of the end cap is substantially similar to the diameter of a shoulder of the outer sheath.

11. The pliable handle of claim 1, wherein the at least one gel injection through bore receives gel during an assembly process.

12. The pliable handle of claim 1, wherein the core member main part and first and second sealers are formed of a material selected from the group consisting of PVC, ABS, PE, and PP plastic.

13. The pliable handle of claim 1, wherein the outer sheath is substantially cylindrical in shape.

14. The pliable handle of claim 1, wherein the outer sheath has first and second shoulders at or near the respective ends thereof, and the diameter of each of the first and second shoulders of the outer sheath corresponds with the diameter of the respective first and second annular flanges of the core member main part.

15. The pliable handle of claim 1, wherein the outer sheath is formed of vulcanized silicone.

16. The pliable handle of claim 1, wherein the outer sheath is one of colorless, colored, and multicolored.

17. The pliable handle of claim 1, wherein the outer sheath is transparent.

18. The pliable handle of claim 1, wherein the outer sheath is opaque.

19. The pliable handle of claim 1, wherein the gel is uniformly disposed about the core member main part.

20. The pliable handle of claim 1, wherein the sheath is uniformly disposed about the core member main part substantially from a first to a second end of the gel-containing portion.

21. The pliable handle of claim 1, wherein the pliable handle is an umbrella handle.

22. The pliable handle of claim 1, wherein the pliable handle is a tool handle.

23. The pliable handle of claim 1, wherein the pliable handle is selected from the group consisting of a handle of a cane, walking stick, sports equipment, garden equipment, kitchen tool, cleaning equipment, writing instrument, and beauty equipment.

24. The pliable handle of claim 1, wherein the outer sheath has ribs formed on the outer surface thereof.

25. The pliable handle of claim 1, wherein the pliable handle is attached to a curved handle portion.

* * * * *

UNITED STATES PATENT AND TRADEMARK OFFICE

CERTIFICATE OF CORRECTION

PATENT NO. : 6,959,469 B2
DATED : November 1, 2005
INVENTOR(S) : Jeff Blauer et al.

It is certified that error appears in the above-identified patent and that said Letters Patent is hereby corrected as shown below:

Title page,
Item [54], Title, should be -- PLIABLE HANDLE --.
Item [75], Inventors, insert:
-- Yen Chiu Chan, Taipei, Taiwan, and Chou Fu-Yi, Taipei, Taiwan, --.
Item [73], Assignee, delete "She drain Corporation, Portland, OR (US)" and substitute -- Shedrain Corporation, Portland, OR (US) --.

Signed and Sealed this

Seventh Day of March, 2006

JON W. DUDAS
*Director of the United States Patent and Trademark Office*